US007494420B1

(12) United States Patent
Whalen

(10) Patent No.: US 7,494,420 B1
(45) Date of Patent: Feb. 24, 2009

(54) SPORTS SWING AID

(76) Inventor: James P. Whalen, 448 River Ter., Toms River, NJ (US) 08753

( * ) Notice: Subject to any disclaimer, the term of this patent is extended or adjusted under 35 U.S.C. 154(b) by 0 days.

(21) Appl. No.: 11/787,178

(22) Filed: Apr. 14, 2007

Related U.S. Application Data

(60) Provisional application No. 60/792,418, filed on Apr. 17, 2006.

(51) Int. Cl.
*A63B 69/36* (2006.01)

(52) U.S. Cl. ..... 473/228; 473/233

(58) Field of Classification Search ..... 473/219, 473/223, 224, 226, 228, 230, 233, 234, 457
See application file for complete search history.

(56) References Cited

U.S. PATENT DOCUMENTS 2,910,297 A * 10/1959 Bonetate ..... 473/228
3,776,556 A * 12/1973 McLaughlin ..... 473/234
4,017,083 A * 4/1977 Johnson ..... 473/231
4,907,800 A * 3/1990 Passamaneck et al. ..... 473/457
5,207,625 A * 5/1993 White ..... 482/111
5,971,828 A * 10/1999 Lin ..... 446/217
6,645,084 B1 * 11/2003 Dayton ..... 473/230
2003/0207719 A1 * 11/2003 Hughes ..... 473/228
2005/0079922 A1 * 4/2005 Priester et al. ..... 473/228
2005/0215339 A1 * 9/2005 Namba ..... 473/228

* cited by examiner

*Primary Examiner*—Nini Legesse
(74) *Attorney, Agent, or Firm*—Michael R. Philips

(57) ABSTRACT

A sports swing aid is adapted for being mounted on a shaft of a sports implement, for example a golf club. The sports swing aid has a conical shaped mounting block with a channel formed to straddle the shaft. A rotor is removably assembled on the mounting block. The rotor has an array of vanes on the periphery thereof to cause the rotor to rotate when the sports implement is moved through the air. An eccentric weight is provided to impart a vibration as the rotor rotates and thus generate feedback to the sports player indicative of the smoothness and speed of the swing.

6 Claims, 4 Drawing Sheets

SPORTS SWING AID

RELATED APPLICATION

This application is a conversion of provisional patent application No. 60/792,418 filed Apr. 17, 2006.

FIELD OF THE INVENTION

The present invention relates to the field of sporting goods, and more particularly to apparatus for aiding and improving a player's swing of a sports implement, e.g. a golf club.

BACKGROUND OF THE INVENTION

Many sports involve swinging a sports implement for propelling a projectile toward an opponent or across a field. These sports include golf, baseball, tennis, lacrosse, etc. A significant component of these games involves the smoothness and power of the player's swing. In the sport of baseball, it is common for a batter to practice swinging the bat with added weight, allowing the player to perceive that a bat of normal weight is light and easily swung. This effect helps the player to swing the non-weighted bat faster and harder, and theoretically to hit the ball farther.

In the sport of golf, conventional theory teaches that a smooth swing is more important than a strong swing to achieve accuracy, although strength can aid in achieving distance. Thus, both smoothness and strength are desired. Many hours of practice are devoted to improving the smoothness and control of the golfer's swing, with or without professional instruction. A major factor of improvement in any learning process is feedback, i.e. transmitting information or tactile sensations about the swing movement to the brain to reinforce the desired swing result. Prior to the present invention, there has been no known aid to help the golfer effectively feel the swing results and instantaneously obtain the important feedback for improving the swing smoothness.

SUMMARY OF THE INVENTION

The sports swing aid of the present invention is comprised of a rotating assembly configured for being mounted on the shaft of a swinging sports implement, for example a golf club. The rotating assembly has a central rotor, a set of vanes assembled to the periphery of the rotor, and a means to transmit information on swing smoothness. The vanes are pitched to cause the rotor to rotate when the implement is being moved through an arc in the air. One means to indicate swing smoothness is a weight mounted eccentrically on the rotor to cause a vibration when the rotor spins. A mounting block is provided to securely, but removably, assemble the rotor and vanes to the shaft of the sports implement. The vibration is transmitted along the implement to the hands of the player as an indication of the speed and smoothness of the swing. In a second embodiment of the invention, the vanes are each rotatable about an axis that extends radially from the rotor and are biased to return to a rest position.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENTS

Figure 1:
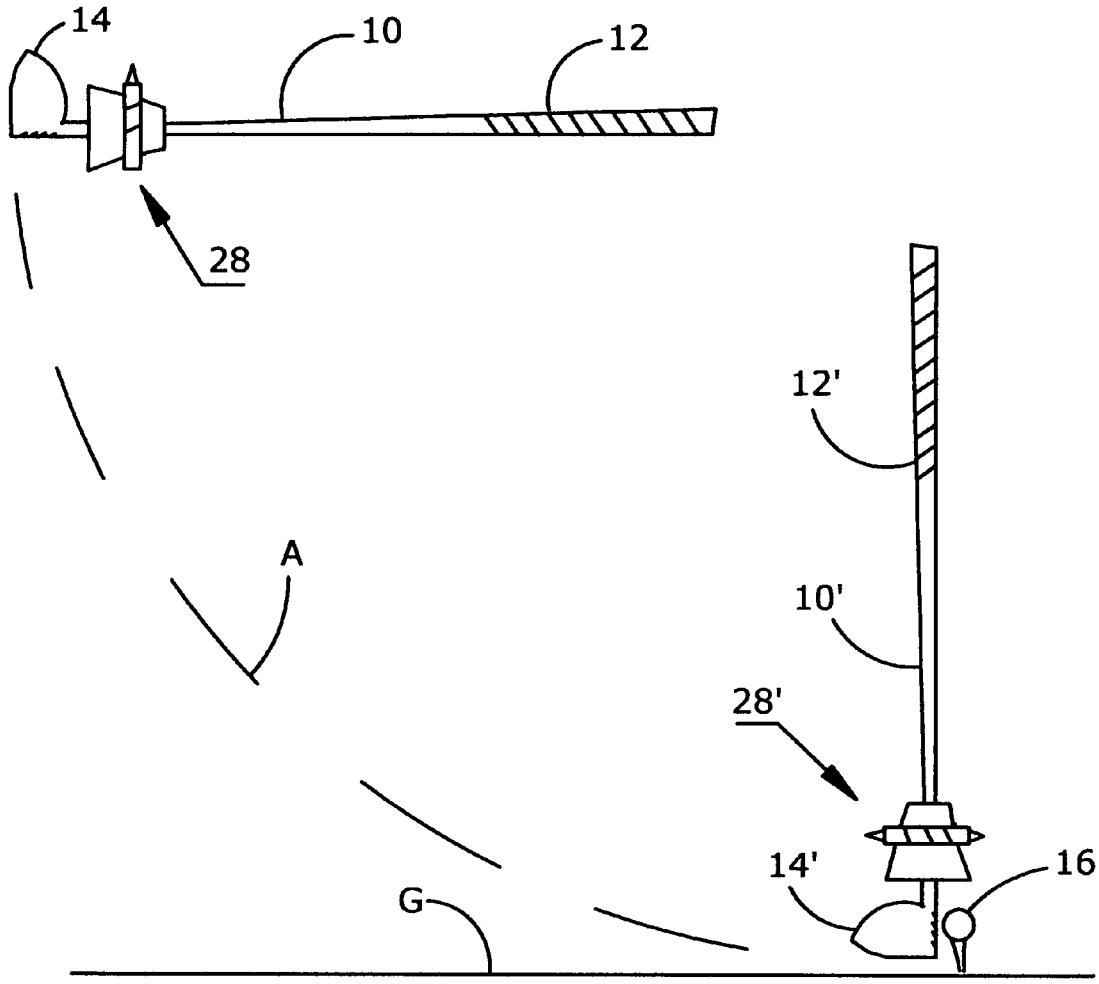
FIG. 1 is a front elevation view of the sports swing aid of the invention in use on a golf club in a first position at the start of a swing and in a second position as the golf club is contacting a golf ball.

Referring now to FIG. 1, a swingable sports implement, illustrated in the form of a golf club 10, is depicted first in a position at the middle of a downward swing. When golf club 10 has been moved rapidly along the arc A to a second position for hitting a golf ball 16 on ground G, the golf club is labeled golf club 10'. Golf club 10, 10' has a grip 12, 12' and a head 14, 14', as is known. A sports swing aid 28, 28' is mounted on golf club 10, 10' adjacent to head 14, 14' to rotate in a plane substantially perpendicular to the length of golf club 10, 10'. As golf club 10 is moved from its upper position through arc A to the ball-impacting position of golf club 10', swing aid 28 passes through the air, causing swing aid 28 to rotate around golf club 10 by the resistance of the air.

Figure 2:
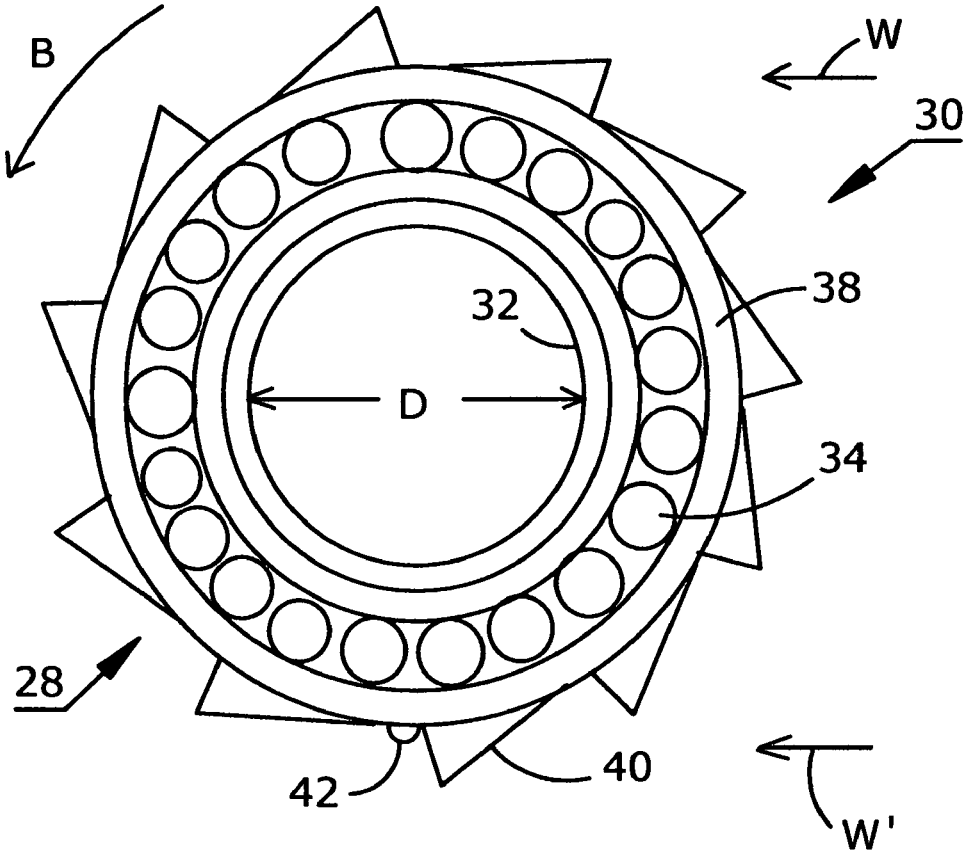
FIG. 2 is a top plan view of a rotor of the sports swing aid according to a first embodiment.
Figure 3:
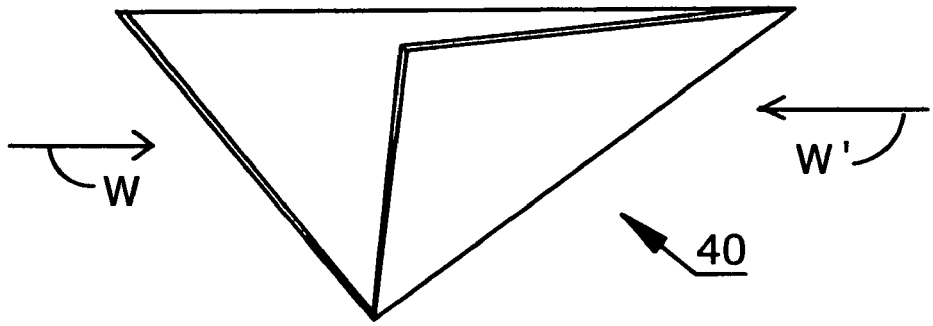
FIG. 3 is an enlarged perspective view of a vane of the rotor of FIG. 2.

Referring now to FIGS. 2 and 3, a first preferred embodiment of swing aid 28 is shown in top plan view, comprising a rotor 30 and an array of vanes 40, with an enlarged depiction of vane 40 being shown in perspective view in FIG. 3. Rotor 30 has an inner race 32, a plurality of rotary support members, depicted as balls 34, and an outer race 38. Rotor 30 is optionally a ball bearing, although variations such as roller bearings or air cushion bearings are adaptable to the objects of the invention. Inner race 32, balls 34 and outer race 38 may be formed of various metal or non-metal materials to achieve different results. Inner race 32 has an inside diameter D sized to allow grip 12 of golf club 10 (see FIG. 1) to pass therethrough and for being mounted on a mounting block to be described below. Vanes 40 are asymmetrical and oriented circumferentially uniformly around outer race 38. When movement of golf club 10 through arc A (see FIG. 1) causes swing aid 28 to be impinged by air movement W, the geometry of vanes 40 causes rotor 30 to rotate in the direction indicted by arrow B. As illustrated, vanes 40 at the top of swing aid 28 create resistance to wind W, and the shape of vanes 40 at the bottom of swing aid 28 allow wind W' to pass thereby relatively freely. Reversal of the mounting orientation of rotor 30 on golf club 10 (see FIG. 1) causes rotor 30 to rotate in the opposite direction. In this manner, swing aid 28 may be used by a right handed or a left handed player. A single weight 42 is mounted to outer race 38 to create an eccentricity, or unbalanced weight condition, and cause rotor 30 to vibrate due to the weight imbalance as golf club 10 is being swung. The degree of vibration is directly associated with the swing movement, providing a direct feedback of the swing rhythm to the player. Other means to provide feedback of the rhythm, speed and smoothness of the swing are available, e.g. a flexible member fixedly mounted to contact the rotating vanes and cause a clicking noise, are considered to be within the scope of the present invention. When impinged by wind W (vane 40 situated at the top of swing aid 28), vane 40 is driven in the direction of arrow B. When wind W' passes vane 40 (vane 40 situated at the bottom of swing aid 28) little resistance is encountered. Thus swing aid 28 rotates as intended.

Figure 4:
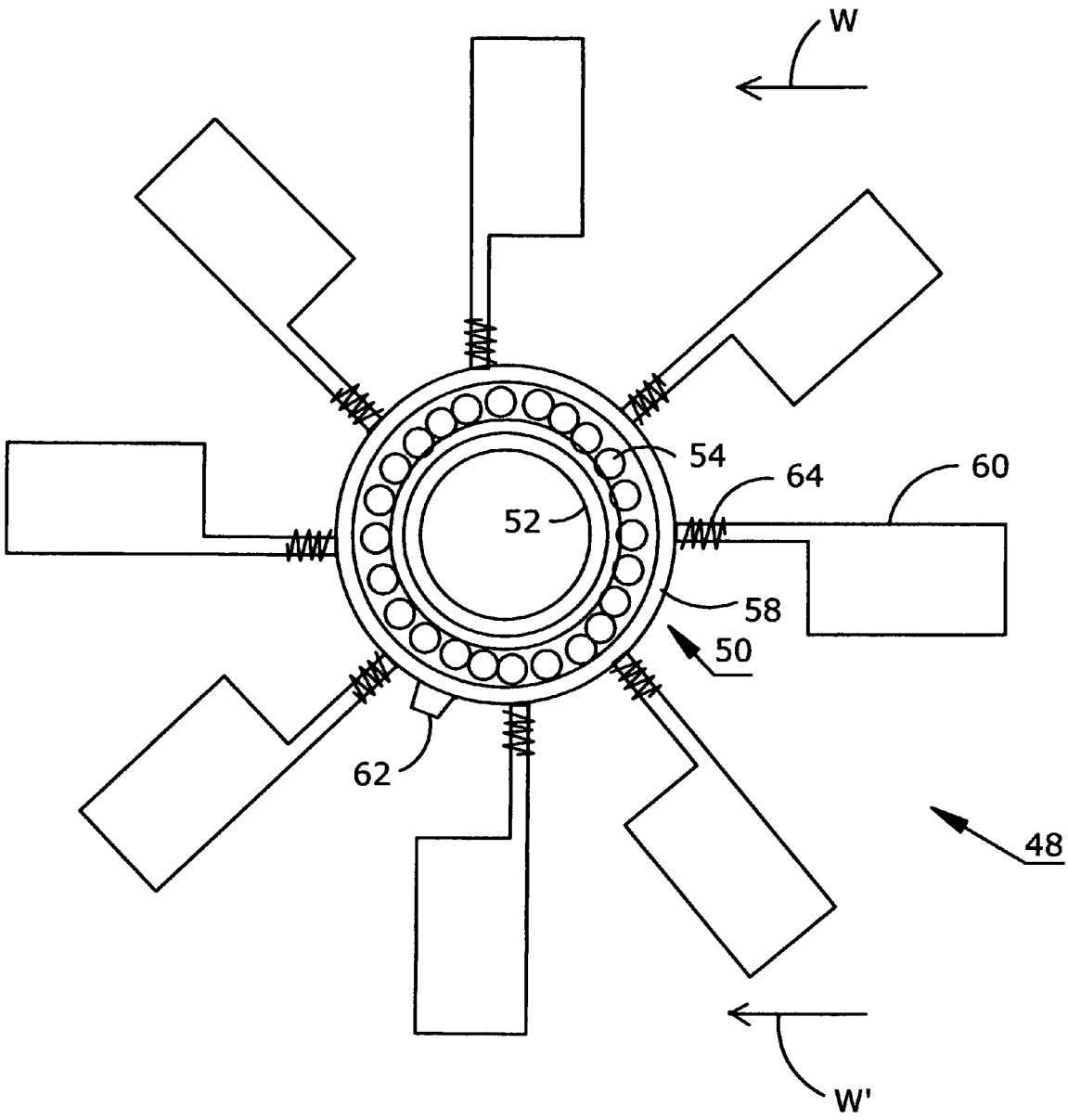
FIG. 4 is a top plan view of a rotor of the sports swing aid according to a second embodiment.
Figure 5:
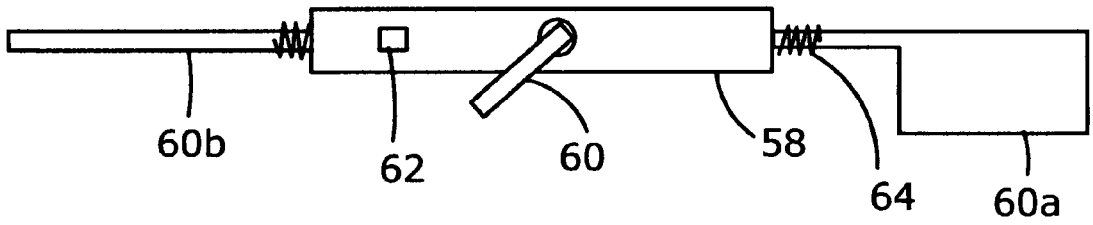
FIG. 5 is a side elevation view of the rotor of FIG. 4.

Referring now to FIGS. 4 and 5, a second preferred embodiment of the invention is shown as alternate embodiment swing aid 48 in top plan view and side elevation view respectively. For clarity, FIG. 5 is shown with only 3 blades 60, 60*a* and 60*b*. Swing aid 48 has a rotor 50 comprising inner race 52, balls 54 and outer race 58. A series of blades 60 are mounted in an array around the circumference of rotor 50 with each blade 60 oriented similarly when at rest. Each blade 60 is biased by a torsion spring 64 to cause blade 60 to return to the rest position when not being impinged by wind caused by the motion of golf club 10 (see FIG. 1). The rest position of each blade 60 is shown at the center of FIG. 5 at an angle to the axis of outer race 58. Blades 60 are asymmetrical in order to be rotated by air resistance from the orientation of blade 60 to the orientation of blade 60*a* when impinged by wind W (see FIG. 4) and to the orientation of blade 60*b* when passed by wind W'. A weight 62 is mounted at an arbitrary position on outer race 58 to generate a vibration as described above.

Figure 6:
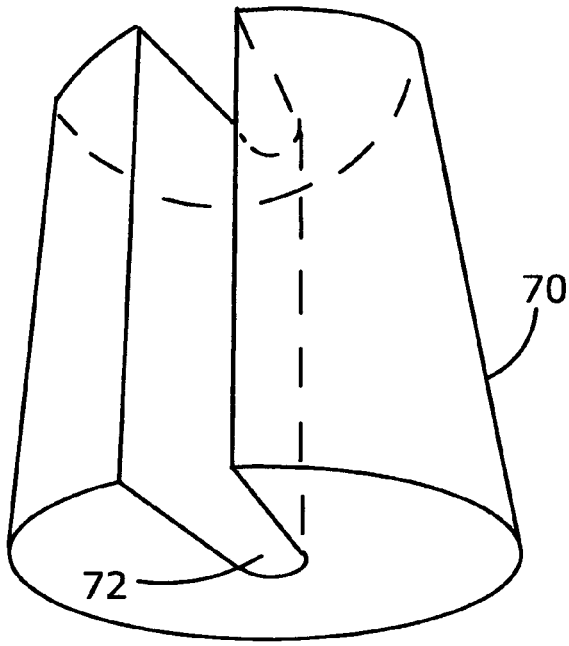
FIG. 6 is a perspective view of the mounting block of the sports swing aid disclosed.

Referring now to FIG. 6, a mounting block 70 is shown in perspective view. Mounting block 70 is preferably formed with a conical outer surface configured and sized to receive rotor 30 (see FIG. 2) or rotor 50 (see FIG. 4) thereon. Other shapes of mounting block 70 are contemplated to be within the scope of the invention. Mounting block 70 has a channel 72 that is sized to be mounted snugly on the shaft of golf club 10 (see FIG. 1) in any selected position between head 14 and grip 12, although assembling mounting block 70 adjacent to head 14 is preferred. Mounting block 70 is preferably formed of a resilient material having a highly frictional surface, for example foam rubber, to retain the position of swing aid 28 or swing aid 48 on golf club 10 as golf club 10 is swung. The position of mounting block 70 along the shaft portion of golf club 10 affects the speed of rotation of rotor 30 or rotor 50 and the frequency of vibration caused.

While the description above discloses preferred embodiments of the present invention, it is contemplated that numerous variations and modifications of the invention are possible and are considered to be within the scope of the claims that follow.

What is claimed is:

1. A sports swing aid, comprising:

a. a mounting block configured for being mounted at a selected position on a shaft of a sports implement for swinging;

b. a rotor removably mounted on the mounting block;

c. a series of radially extending members assembled to an outer diameter of the rotor;

d. means to provide to a user of the sports implement feedback of the rhythm, speed and smoothness of swinging; and e. wherein the radially extending members are asymmetrically configured blades rotatably mounted to cause the rotor to rotate as the sports implement with the rotor mounted thereon is swung through an arc, the blades fitted with a plurality of torsion springs for biasing the blades to a rest position.

2. The sports swing aid described in claim 1, wherein the means to provide feedback comprises an eccentrically mounted weight.

3. The sports swing aid described in claim 1, wherein the rotor comprises a rotatable bearing.

4. The sports swing aid described in claim 1, wherein the mounting block is resilient and has a highly frictional surface.

5. The sports swing aid described in claim 1, wherein the mounting block is substantially conical in form.

6. The sports swing aid described in claim 1, wherein the sports implement is a golf club.

* * * * *